US006690345B2

(12) United States Patent
Hanzawa et al.

(10) Patent No.: US 6,690,345 B2
(45) Date of Patent: Feb. 10, 2004

(54) LIQUID CRYSTAL DISPLAY DEVICE

(75) Inventors: Kenji Hanzawa, Hyogo (JP); Shuji Hagino, Kobe (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 215 days.

(21) Appl. No.: 10/029,807

(22) Filed: Dec. 27, 2001

(65) Prior Publication Data

US 2002/0089482 A1 Jul. 11, 2002

(30) Foreign Application Priority Data

Dec. 28, 2000 (JP) ..... 2000-402656

(51) Int. Cl.[7] ..... G09G 3/36
(52) U.S. Cl. ..... 345/95; 345/94; 345/99
(58) Field of Search ..... 345/87, 92, 94, 345/95, 98, 99, 100, 208, 210

(56) References Cited

U.S. PATENT DOCUMENTS

| | | | | | |
|---|---|---|---|---|---|
| 5,248,963 | A | * | 9/1993 | Yasui et al. | 345/98 |
| 5,592,191 | A | * | 1/1997 | Tsuboyama et al. | 345/97 |
| 5,606,343 | A | * | 2/1997 | Tsuboyama et al. | 345/97 |
| 5,629,718 | A | * | 5/1997 | Surguy | 345/99 |
| 6,151,016 | A | * | 11/2000 | Kanbe et al. | 345/204 |
| 6,552,708 | B1 | * | 4/2003 | Wang et al. | 345/98 |

FOREIGN PATENT DOCUMENTS

| | | | |
|---|---|---|---|
| EP | 0316801 A2 | 5/1989 | G09G/3/36 |
| EP | 0881622 A1 | 12/1998 | G09G/3/36 |
| EP | 1041533 A1 | 10/2000 | G09G/3/36 |

* cited by examiner

*Primary Examiner*—Kent Chang

(57) ABSTRACT

After image is reduced by shortening the erasing time after turnoff of the power supply by providing charge flow paths.

13 Claims, 4 Drawing Sheets

LIQUID CRYSTAL DISPLAY DEVICE

TECHNICAL FIELD

The invention relates to a liquid crystal display device provided with a first electrode and a second electrode for applying the voltage to a liquid crystal layer.

BACKGROUND OF THE INVENTION

In case of erasing images displayed on a liquid crystal display by means of turning off the power supplied to the concerned display, there are some liquid crystal displays in which the time between the moment at which the power supplied to the said liquid crystal display has been turned off and the full erasure of the image from said liquid crystal display (said time will be referred to as "erasing time" hereinafter) is needed 4 to 5 seconds or even about 30 seconds. The reason of the longer erasing time may exist mainly in that the voltage having a certain magnitude may be still applied to a liquid crystal layer for a while even after the turnoff of the power supply. The longer erasing time results in that the afterimage remains on the display for the longer time. Since such afterimage is obtrusive to the user, it is required to shorten the erasing time in such a way that the afterimage erases as quickly as possible.

One of the known techniques for shortening the erasing time in case of, for example, TFT type liquid crystal display devices, is a method for providing a gate driver with a function of switching all TFTs to the ON state immediately after the power for the liquid crystal display device has been turned off (such function will be referred to as "ALL-ON" function hereinafter). If a gate driver provided with such function is used, the OFF image data could be written to pixel electrodes immediately after the power for the liquid crystal display device has been turned off, so that the potential of the pixel electrodes may be immediately changed to a zero potential. Accordingly, the erasing time can be shortened because the potential difference between the pixel electrodes and the common electrode becomes substantially zero in a short time.

In the case of performing the ALL-ON function of the gate driver, a power detection circuit or a signal detection circuit which are dedicated for performing the ALL-ON function is additionally required. The power detection circuit detects the externally supplied voltage and controls the ALL-ON function in accordance with the detected voltage. The signal detection circuit detects not only the externally supplied voltage but also a signal (for example, horizontal synchronization signal) or detects only said signal and controls the ALL-ON function in accordance with the detected voltage and signal or only said signal.

In the case of using such voltage detection circuit, there is a problem of increasing the cost because an expensive voltage detection IC is required. On the other hand, in the case of using the signal detection circuit, there is also a problem that the specification of the signal detection circuit must be changed depending on the characteristic (e.g., amplitude and/or frequency) of the signal to be detected.

From a viewpoint of the aforementioned situation, it is an object of the invention to provide a liquid crystal display device that is less expensive but capable of shortening the erasing time without detecting, for example, the horizontal synchronization signal.

SUMMARY OF THE INVENTION

A first liquid crystal display device in accordance with the invention in order to achieve the above-described objective comprises a first electrode and a second electrode for applying a voltage to a liquid crystal layer, a first bus and a second bus that are electrically connected to said first electrode via first switching means, potential generation means for generating a first potential that is supplied toward said first switching means via a path containing said first bus, a charge flowing portion into which electric charges existing in said path, said first electrode or said potential generation means may flow and a second switching means for switching a state of the flow of electric charges into said charge flowing portion to either a first sate in which said electric charges flow into said charge flowing portion or a second state in which said electric charges do not flow into said charge flowing portion so much as in said first state.

The first liquid crystal display device in accordance with the invention is provided with the charge flowing portion into which electric charges existing in said path, said first electrode or said potential generation means may flow. Furthermore, the state of the flow of electric charges into this charge flowing portion is switched by the second switching means. Accordingly, when this charge flowing portion is shifted from the second sate to the first state, the electric charge existing in said path, said first electrode or said potential generation means could efficiently flow into this charge flowing portion, and as a result, the potentials of said path, said first electrode or said potential generation means could be quickly changed by an potential corresponding to the amount of electric charges that have flowed into this charge flowing portion. Thus, the erasing time could be shortened, as will be later described, by means of changing the potentials of said path, said first electrode or said potential generation means. Besides, with the aforementioned charge flowing portion, it is possible to shorten the erasing time at a low cost without detecting, for example, the horizontal synchronization signal as will be described later.

In accordance with a first aspect of the invention, it is preferable that said charge flowing portion is set to said first state when said second switching means is in an ON state whereas said charge flowing portion is set to said second state when said second switching means is in an OFF state. Thus, the charge flowing portion could be set to either first state or second state by means of switching said second switching means to either ON or OFF state.

In accordance with a second aspect of the invention, the aforementioned first liquid crystal display device preferably further comprises control means for controlling said second switching means so that said second switch means is switched to either an ON state or an OFF state. With such control portion, the switching between the ON state and the OFF state of said second switching means could be easily performed.

In accordance with a third aspect of the invention, said potential generation means for the aforementioned first liquid crystal display device generates a plurality of potentials, and that said control portion detests said plurality of potentials generated by said potential generation means and controls said second switching means so that said second switch means is switched to either an ON state or an OFF state on the basis of said detected potentials. In accordance with such structure of the control portion, the control portion does not need to detect a signal (for example, horizontal synchronization signal), and as a result, the control portion could be designed without reference to the signal characteristic.

In accordance with a fourth aspect of the invention, the aforementioned first liquid crystal display device preferably further comprises a first driver for transmitting signals to said first bus and a second driver for transmitting signals to said second bus, and that said potential generation means generates a second potential to be supplied toward said first driver and a third potential to be supplied toward said second driver in addition to said first potential, and that said control portion detects said first, second and third potentials and controls said second switching means so that said second switching means is switched to either an ON state or an OFF state on the basis of said detected potentials. By means of detecting these first, second and third potentials generated by said potential generation means, the control portion could be designed without reference to the signal characteristic.

In accordance with a fifth aspect of the invention, said control portion for the aforementioned first liquid crystal display device preferably comprises a third switching means for switching an ON state and an OFF state of said second switching means. Through easy switching of said third switching means, the switching between the ON state and the OFF state of said second switching means could be easily controlled.

Furthermore, in the aforementioned first liquid crystal display device, said first electrode may be a pixel electrode and said second electrode may be a common electrode, said first bus may be a gate bus and said second bus may be a source bus, and said first driver may be a gate driver and said second driver may be a source driver.

Moreover, the invention provides a second liquid crystal display device comprising a first electrode and a second electrode for applying a voltage to a liquid crystal layer, a first bus and a second bus which are electrically connected to said first electrode via first switching means, and potential generation means for generating a first potential which is supplied toward said first bus, characterized in that said potential generation means generates a second potential to be supplied toward said first bus when the supply of the power for said potential generation means has been stopped, said second potential being larger than said first potential.

In particular, the potential generation means provided in the aforementioned second liquid crystal display device generates the second potential larger than said first portion when the supply of the power for said potential generation means has been stopped. That second potential is supplied toward said first bus. By means of the supply of the second potential larger than the first potential toward the first bus when the supply of the power for said potential generation means has been stopped, the erasing time could be shortened as will be later described. Besides, in accordance with the aforementioned potential generation means provided in the second liquid crystal display device, it is possible to shorten the erasing time at a low cost without detecting, for example, the horizontal synchronization signal as will be described later.

In accordance with a further aspect of the invention, said potential generation means in the aforementioned second liquid crystal display device preferably comprises a differential amplifier that outputs said second potential. With such differential amplifier, the second potential could be generated through a simple circuit structure.

Furthermore, in the aforementioned second liquid crystal display device, said first electrode may be a pixel electrode and said second electrode may be a common electrode, and said first bus may be a gate bus and said second bus may be a source bus.

DETAILED DESCRIPTION OF THE INVENTION

Figure 1:
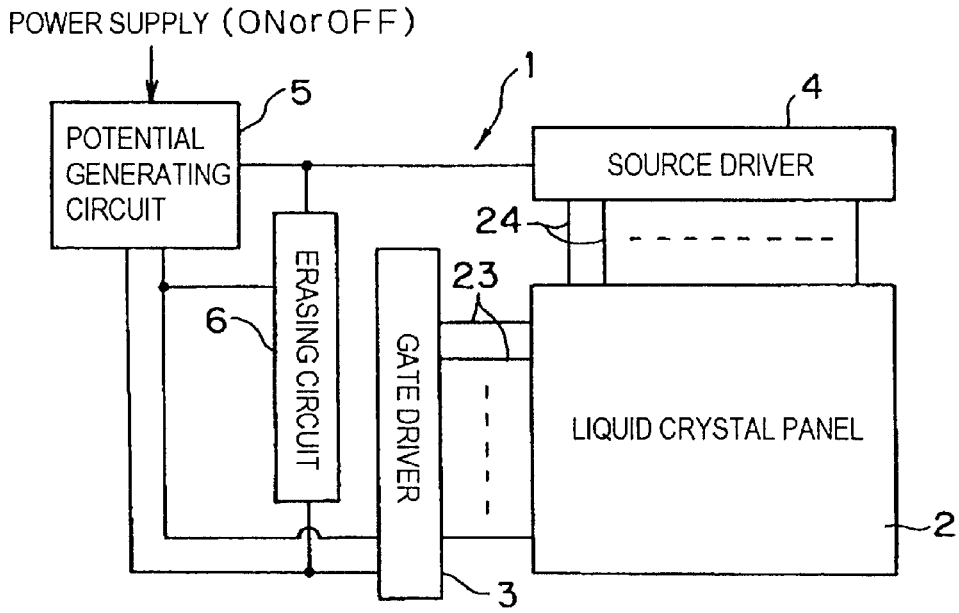
FIG. 1 is a schematic diagram illustrating an exemplary TFT liquid crystal display as a first embodiment of the liquid crystal display device in accordance with the invention.

Following will describe some embodiments of the invention. FIG. 1 is a schematic diagram illustrating an exemplary TFT liquid crystal display as a first embodiment of the liquid crystal display device in accordance with the invention. This TFT liquid crystal display (simply referred to as "display" hereinafter) 1 comprises a liquid crystal panel. The liquid crystal panel 2 displays color images and constructs pixels representing each color of R (red), G (green) and B (blue).

Figure 2:
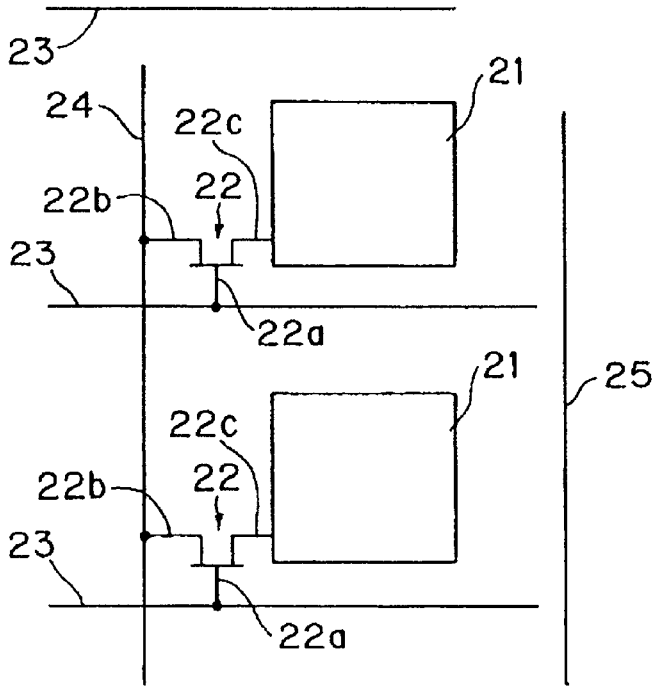
FIG. 2 is a schematic diagram illustrating the pixel structure of the liquid crystal panel 2.

FIG. 2 is a schematic diagram illustrating the pixel structure of the liquid crystal panel 2. The liquid crystal panel 2 comprises gate buses 23 and source buses 24 both of which extend vertically each other. In this embodiment, there are provided 800 gate buses 23 and 3072 source buses 24, but the number of these gate and source buses may be variable depending on the application of the display 1. In FIG. 2, three gate buses 23 and one source bus 24 are only illustrated. The liquid crystal panel 2 also comprises a pixel electrode 21 and a TFT 22 in each pixel. In FIG. 2, two pixel electrodes 21 and two TFT 22 are only illustrated as exemplary. A drain electrode 22*c* of the TFT 22 is connected to the corresponding pixel electrode 21, a gate electrode 22*a* of the TFT 22 being connected to the corresponding gate bus 23 and a source electrode 22*b* of the TFT 22 is connected to the source bus 24. The liquid crystal panel 2 further comprises a common electrode 25. The common electrode 25 is in fact extending two-dimensionally so as to face with each pixel electrode 21 via a liquid crystal layer (not shown herein), but the common electrode 25 is represented by a single straight line in FIG. 2 for the simple illustration purpose.

Referring back to FIG. 1, around the liquid crystal panel 2, there are disposed a gate driver 3 and a source driver 4, both of which are connected to a potential generating circuit 5. The display 1 also comprises a erasing circuit 6 for easing instantaneously the image being displayed on the liquid crystal panel 2 immediately after the supply of DC power supply for the potential generating circuit 5 has been stopped.

Figure 3:
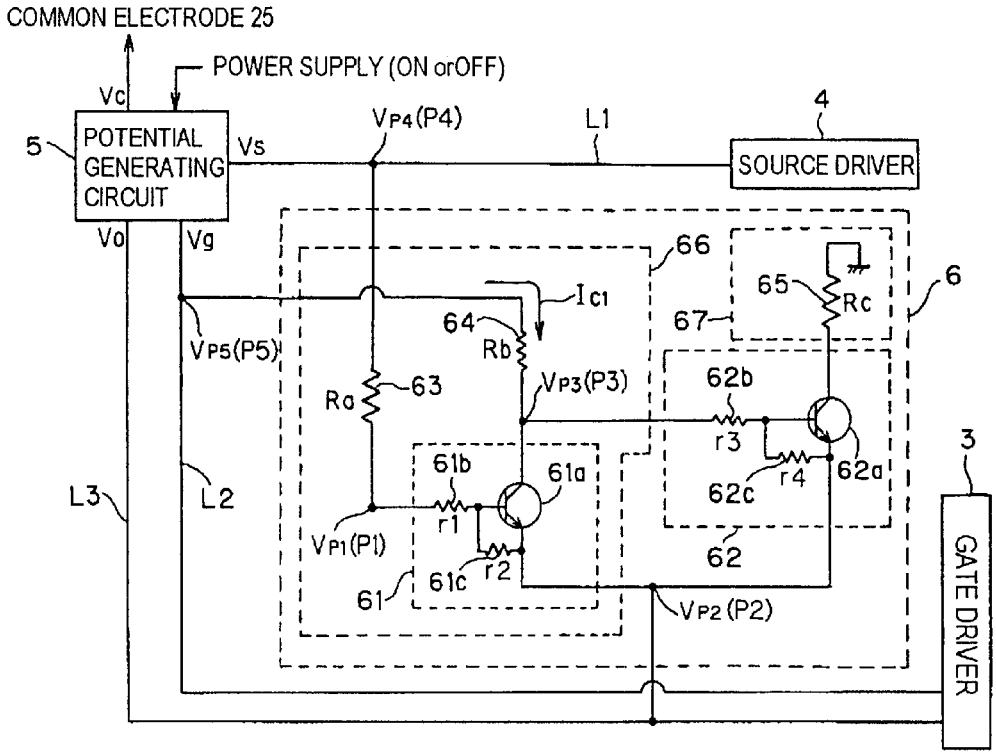
FIG. 3 is a schematic diagram illustrating the structure of the erasing circuit 6 and the connection relation of the erasing circuit 6 with its related circuits.

FIG. 3 is a schematic diagram illustrating the structure of the erasing circuit 6 and the connection relation of the erasing circuit 6 with its related circuits. The potential generating circuit 5 generates predetermined potentials Vs, Vg, Vo and Vc. The potentials Vs, Vg and Vc are positive ones but the potential Vo is a negative one. The potential Vs is supplied toward the source driver 4. The potentials Vg and Vo are toward the gate driver 3. The potential Vc is supplied toward the common electrode 25 (see FIG. 2).

As shown in FIG. 3, the erasing circuit 6 comprises a charge flowing portion 67 having a resistor 65. The charge flowing portion 67 is connected to a switching element 62.

The switching element 62 comprises a transistor 62*a* and resistors 62*b* and 62*c*. A collector of the transistor 62*a* is grounded via a protection resistor 65 and an emitter of the transistor 62*a* is connected to the gate driver 3 via a supplying line L3 of the potential Vo. The erasing circuit 6 furthermore comprises a control portion 66 for controlling the ON/OFF of the switching element 62. The control portion 66 is provided with a switching element 61 which is the same structure as the switching element 62. The switching element 61 comprises a transistor 61*a* and resistors 61*b* and 61*c*. A collector of the transistor 61*a* is connected to the switching element 62 via a point P3 and to a supplying line L2 of the potential Vg via a resistor 64. An emitter of the transistor 61*a* is connected to the emitter of the transistor 62*a* and to the supplying line L3 at a point P2. A base of the transistor 61 is connected to a supplying line L1 of the potential Vs via the resistors 61*b* and 63. The switching element 61 becomes an ON state when the potential difference $V_{P1}-V_{P2}$ between the potential $V_{P1}$ at the point P1 and the potential $V_{P2}$ at the point P2 satisfies the following equation (1):

$$V_{P1}-V_{P2}\geqq V_{ON} \quad (1)$$

The switching element 61 becomes an OFF state when the potential difference $V_{P1}-V_{P2}$ satisfies the following equation (2)

$$V_{P1}-V_{P2}\leqq V_{OFF} \quad (2).$$

In case of $V_{ON}>V_{P1}-V_{P2}>V_{OFF}$, it is unstable whether the switching element 61 becomes the ON state or the OFF state. The switching element 61 may become the ON state or the OFF state depending on the characteristic of the product using as said switching element 61.

The switching element 62, which has the same characteristic as the switching element 61, also becomes an ON state when the potential difference $V_{P3}-V_{P2}$ between the potential $V_{P3}$ at the point P3 and the potential $V_{P2}$ at the point P2 satisfies the following equation (3):

$$V_{P3}-V_{P2}\geqq V_{ON} \quad (3)$$

The switching element 62 becomes an OFF state when the potential difference $V_{P3}-V_{P2}$ satisfies the following equation (4):

$$V_{P3}-V_{P2}\leqq V_{OFF} \quad (4)$$

In case of $V_{ON}>V_{P3}-V_{P2}>V_{OFF}$, it is unstable whether the switching element 62 becomes the ON state or the OFF state. The switching element 62 may become the ON state or the OFF state depending on the characteristic of the product using as said switching element 62.

Now, the operation of the display 1 shown in FIG. 1 will be described with reference to FIG. 1 through FIG. 3. Initially, when the power of the main body of the display 1 is turned on, the DC power is supplied to the potential generating circuit 5, so that the circuit 5 starts generating the potentials Vs, Vg, Vo and Vc. The potential Vs is to drive the source driver 4, the potentials Vg and Vo are to be supplied toward the gate buss 23 (see FIG. 1) via the gate driver 3, and the potential Vc is to be supplied toward the common electrode 25.

Immediately after the potential generating circuit 5 starts generating the potentials, the potential $V_{P2}$ at the point P2 has not reached yet the potential Vo but is nearly equal to zero potential and the potential $V_{P4}$ at the point P4 also has not reached yet the potential Vs but is nearly equal to zero potential. As a result, the potential difference $V_{P1}-V_{P2}$ between the points P1 and P2 is almost zero, and accordingly the switching element 61 satisfies the equation (2), namely, the element 61 is in the OFF state. However, as the time elapses after the start of the generation of the potentials by the potential generating circuit 5, the potential at the point P2 approaches the potential Vo (which is a negative value) whereas the potential at the point P4 approaches the potential Vs (which is a positive value), so that the potential difference $V_{P1}-V_{P2}$ between the points P1 and P2 will gradually increase. Here, the potential difference $V_{P1}-V_{P2}$ between the points P1 and P2 can be represented by the following equation (5) using the potential $V_{P4}$ at the point P4:

$$V_{P1}-V_{P2}=(V_{P4}-V_{P2})\times(r1+r2)/(Ra+r1+r2) \quad (5)$$

where r1 and r2 are the resistance values for the resistors 61*b* and 61*c*, respectively. Further, Ra is a resistance value for the resistor 63.

In this embodiment, the values of the potentials Vo and Vs and the values Ra, r1 and r2 of the resistors 63, 61*b* and 61*c* are selected so as to satisfy the equation (1) when the potential generating circuit 5 has generated the potentials Vo and Vs. Thus, the potential difference $V_{P1}-V_{P2}$ satisfies the equation (2) when the supply of the DC power for the potential generating circuit 5 is being stopped, but the potential difference $V_{P1}-V_{P2}$ become large gradually by starting the supply of the DC power for the potential generating circuit 5, so that the potential difference $V_{P1}-V_{P2}$ satisfies equation (1) eventually. At the time when the potential difference $V_{P1}-V_{P2}$ satisfies equation (1), the switching element 61 exists in the ON state with reliability. When the switching element 61 becomes the ON state, the collector current $I_{C1}$ flows through the switching element 61 that is in the ON state, and the potential V3 at the point P3 becomes almost equal to the potential V2 at the point P2. Accordingly, the potential difference $V_{P3}-V_{P2}$ between the points P3 and P2 is nearly equal to zero. So, the switching element 61 now satisfies the equation (4), namely, the switching element 61 is in the OFF state. Thus, the supplying lines L2 and L3 for supplying the potentials Vg and Vo are placed in such state that the lines L2 and L3 are being electrically disconnected from the charge flowing portion 67 having the resistor 65.

When the potentials Vg and Vo are supplied to the gate driver 3 that has been electrically disconnected from the charge flowing portion 67, the gate driver 3 supplies the potentials Vg or Vo for each of 800 gate buses 23. Specifically, the gate driver 3 sequentially selects each one of these 800 gate buses to supply the potential Vg only for the selected one gate bus 23 and supply the potential Vo for the remaining 799 gate buses. As a result, only the TFT 22 (see FIG. 3) connected to that gate bus 23 receiving the potential Vg could be turned to the ON state. At this time, the image signal is transmitted to all source buses from the source driver 4. Thus, in accordance of the sequence of the selection by the gate bus 23, the image will be sequentially written to each pixel, so that one desired image could be displayed on the liquid crystal panel 2. Then, the same steps for the selection of the gate buses will be repeated and the images will be displayed consecutively.

Now, the operation when the power supply in the main body of the display 1 has been turned off will be below explained with reference to FIG. 4 as well as FIG. 1 through FIG. 3.

Figure 4:
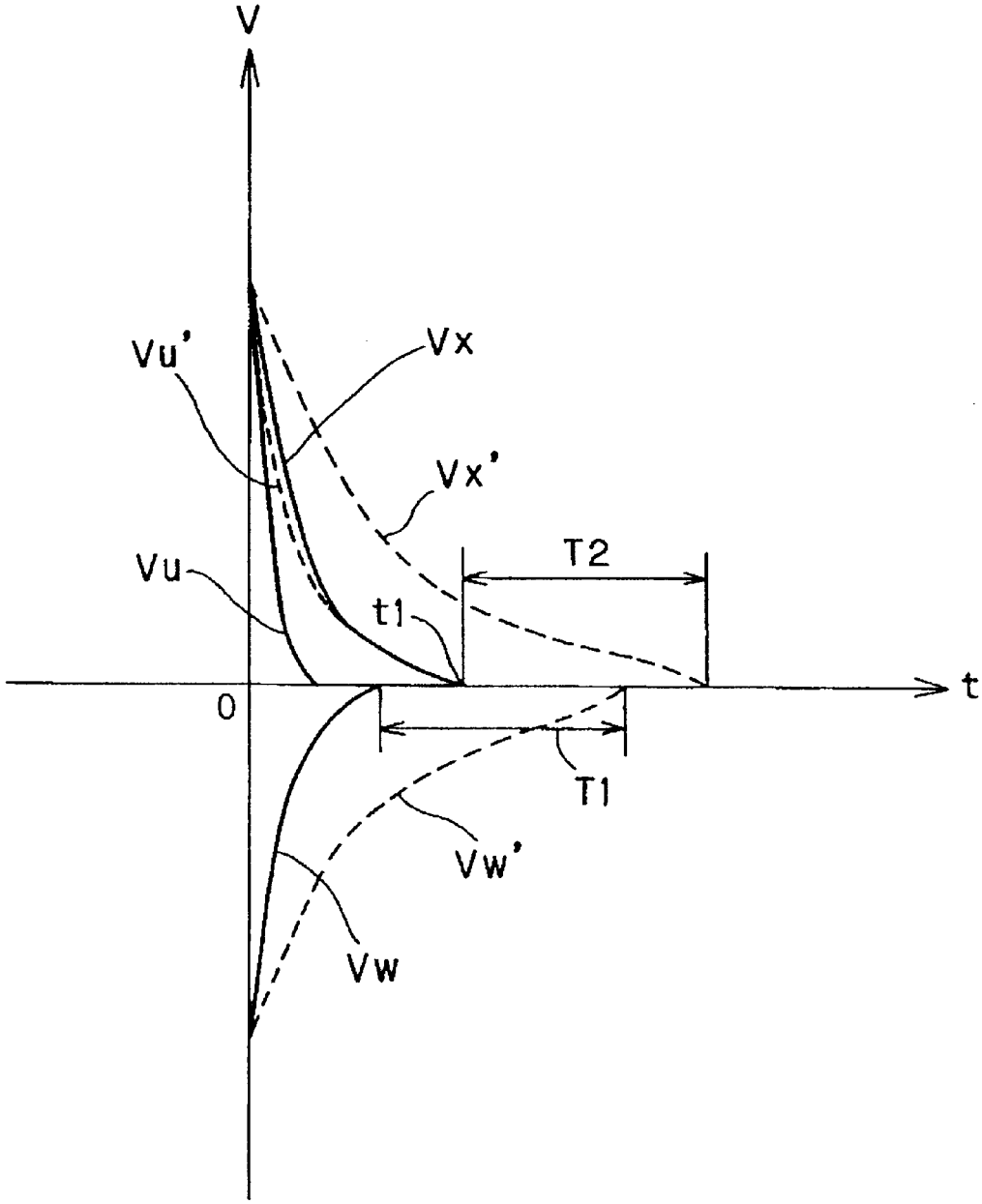
FIG. 4 is a graphical chart illustrating the variation of potentials.

FIG. 4 is a graphical chart illustrating the variation of the potential when the power supply in the main body of the display 1 has been turned off. When the power supply in the main body of the display 1 has been turned off at a time t=0, the image signal that has been supplied to the source bus 24 from the source driver 4 is turned off and the supply of DC power for the potential generating circuit 5 is stopped, so that the circuit 5 stops generating the generation of the potentials Vs, Vg, Vo and Vc. When the potential generating circuit 5 stops generating the potentials Vs, Vg, Vo and Vc, each of the potentials Vs, Vg, Vo and Vc may gradually approach to the zero potential and eventually become zero. In this embodiment, when the potential generating circuit 5 stops generating the potentials Vs, Vg, Vo and Vc, the potential of the common electrode 25 become zero firstly. In FIG. 4, the curve Vu schematically represents how the potential of the common electrode 25 becomes zero.

Besides, one gate bus to which the potential Vg is supplied (referred to as simply "one gate bus" hereinafter) is connected to the supplying line L2 whereas 799 gate buses to which the potential Vo is supplied (referred to as simply "799 gate buses" hereinafter) are connected to the supplying line L3. As far as the one gate bus 23 concerns, this "one gate bus" 23 holds a value almost equal to the Vg (>0) immediately after the potential generating circuit 5 has stopped generating the potentials. Therefore, the TFT 22 that is connected to this "one gate bus" 23 still remains in the ON state immediately after the potential generating circuit 5 has stopped generating the potentials. As a result, a signal indicating that the image signal is OFF, from the source driver 4 via the source bus 24, will be written to the pixel electrode 21 which is connected to the TFT 22 being in such ON state (such pixel electrode will be referred to as "active electrode pixel" hereinafter), so that the potential of this active pixel electrode 21 may instantaneously become zero. Because the potential of this one gate bus 23 and the potential of this active pixel electrode have little effect on erasing time of the display 1 shown in FIG. 1, the following will not further refer to the potential of this one gate bus 23 and the potential of this active pixel electrode but describe in detail about the potentials of the 799 gate buses 23 and the potentials of the pixel electrodes which are electrically connected to those 799 gate buses 23. In the following explanation, the "799 gate buses" will be generally referred to as "gate bus" unless the one gate bus and the 799 gate buses especially need to be distinguished.

When the potential generating circuit 5 stops generating the potentials, the potentials $V_{P4}$, $V_{P5}$ and $V_{P2}$ approach to zero, so that the potential difference $V_{P4}-V_{P2}$ will approach to zero. Accordingly, the potential difference $V_{P1}-V_{P2}$, which was satisfying the equation (1) when the DC power was supplied, gradually decreases and eventually satisfies the equation (2). Once the equation (2) has been satisfied, the switching element 61 becomes the OFF state with reliability. By the way, Comparing the supplying line L2 for supplying the potential Vg and the supplying line L1 for supplying the potential Vs, the supplying line L2 is connected to the gate bus 23 via the gate driver 3 whereas the supplying line L1 is connected to the source bus 24 via the source driver 4. The capacity to be formed between the gate bus 23 and such other electrodes as the pixel electrodes 21 and the common electrode 25 (such capacity is referred as "gate bus capacity", hereinafter) is several times (2 to 3 times) as large as the capacity to be formed between the source bus 24 and the other electrodes (such capacity is referred as "source bus capacity", hereinafter). Because of such difference between the gate bus capacity and the source bus capacity, the potential $V_{P5}$ at the point P5 on the supplying line L2 that is connected to the gate bus 23 may reach the zero potential with a certain time delay relative to the potential $V_{P4}$ at the point P4 on the supplying line L1 that is connected to the source bus 24. Accordingly, immediately after the switching element 61 has been turned to OFF, the potential $V_{P5}$ at the point P5 still holds a sufficiently larger potential than the zero potential. Here, the potential difference $VP_{P3}-V_{P2}$ between the potential $V_{P3}$ at the point P3 and the potential $V_{P2}$ at the point P2 can be represented using the potential $V_{P5}$ at the point P5 as follows:

$$V_{P3}-V_{P2}=(V_{P5}-V_{P2})\times(r3+r4)/(Rb+r3+r4) \quad (6)$$

where r3 and r4 represent resistance values for the resistors 62*b* and 62*c*, respectively. Rb represents a resistance value for the resistor 64.

In this embodiment, the values of the potentials Vo and Vg and the values Rb, r3 and r4 of the resistors 64, 62*b* and 62*c* are selected in such a way that the potential difference $VP_{P3}-V_{P2}$ satisfies the equation (3) immediately after the switching element 61 has become the OFF state. In other words, immediately after the switching element 61 has become the OFF state, the potential difference $V_{P3}-V_{P2}$ is equal to or greater than Von and accordingly the switching element 62 becomes the ON state. In response, the charge flowing portion 67 having the resistor 65 is electrically connected to the supplying line L3 via the switching element 62. That is to say, although the supplying line L3 has been electrically disconnected from the charge flowing portion 67 immediately before the supply of the DC power for the potential generating circuit 5 has been stopped (immediately before t=0), the supplying line L3 is electrically connected to the charge flowing portion 67 via the switching element 62 after the supply of the DC power for the potential generating circuit 5 has been stopped. Besides, because those 799 gate buses 23 are electrically connected to this supplying line L3, the electric charge that has been accumulated on those 799 gate buses may not only naturally discharge toward the circumstance of the gate buses 23 but also flow into the charge following section 67 through the gate driver 3, the supplying line L3 and the switching element 62. In accordance with such movement of the electric charge, the potential of the gate buses 23 eventually becomes zero. The curve Vw in FIG. 4 shows how the potential of the gate buses 23 eventually becomes zero. As the potential of the gate buses becomes zero, the potential of the gate electrode 22*a* of the TFT 22 that is connected to the gate buses 23 also becomes zero.

As above noted, once the supply of DC power for the potential generating circuit 5 has been stopped, a signal indicating that the image signal is OFF will be transmitted from the source driver 4 to each source bus 24. Accordingly, the potential of the source electrode 22*b* of each TFT 22 will also become zero. Thus, as far as the TFT 22 that is connected to the 799 gate buses 23 concerns, the potential of the gate electrode 22*a* and the potential of the source electrode 22*b* of each TFT 22 will both become zero (that is to say, the potential difference between the gate electrode 22*a* and the source electrode 22*b* will become zero). The TFT 22 generally becomes a full OFF state when the potential of the gate electrode 22*a* is somewhat smaller than the potential of the source electrode 22*b*, but in the aforementioned case in which the potential difference between the gate electrode 22*a* and the source electrode 22*b* is nearly equal to zero, the TFT is not placed in a full OFF state but in a state where the current is slightly flowing (this state will be referred to as "HALF-ON state" hereinafter). The electric charge accumulated on the pixel electrode 21 that is connected to the TFT 22 in such HALF-ON state may not only naturally discharge toward the circumstance of this pixel electrode 21 but also flow into the gate bus 23 and the source bus 24 through the TFT 22 being in such HALF-ON state. In accordance with such movement of the charge, the potential of the pixel electrode 21 that is connected to the TFT 22 being in such HALF-ON state eventually becomes zero. The curve Vx in FIG. 4 shows how the potential of said pixel electrode 21 eventually becomes zero.

Thus, the potential of the pixel electrode 21 of the liquid crystal panel 2 becomes zero (curve Vx). As seen from the curve Vx, the potential of the pixel electrode 21 becomes zero at a time t1. Therefore, at the time t1, the difference between the potential of the common electrode 25 (curve Vu) and the potential of each pixel electrode 21 (curve Vx) is zero, so that the display of the liquid crystal panel 2 can be completely erased.

In accordance with the aforementioned structure, the erasing time te until the display of the liquid crystal panel 2 is completely erased is te=t1. Specifically, te=about 1 to 2 seconds.

Now consider the case in which the display 1 shown in FIG. 1 is not provided with the erasing circuit 6. In this case, the display does not comprise the charge flowing portion 67 that is to be connected to the supplying line 3 when the supply of DC power for the potential generating circuit 5 has been stopped. Accordingly, the display that is not provided with the erasing circuit 6, in comparison with the display that is provided with the erasing circuit 6, has a less number of the paths into which the electric charge accumulated on the gate bus 23 can flow, so that the potential variation in the gate bus 23 of the display that is not provided with the erasing circuit 6 may be more moderate than that of the display that is provided with the erasing circuit 6. More specifically, as seen in FIG. 4, with regards to the display that is provided with the erasing circuit 6, the potential variation in the gate bus 23 is represented by a curve Vw, whereas with regards to the display that is not provided with the erasing circuit 6, the potential variation in the gate bus 23 is represented by a curve Vw' indicated by a broken line. Therefore, in the case of the display that is not provided with the erasing circuit 6, the instant when the potential of the gate bus 23 becomes zero is delayed by T1 in comparison with the display that is provided with the erasing circuit 6. Accordingly, as for the display that is not provided with the erasing circuit 6, the instant when the TFT 22 connected to the gate buses 23 becomes the HALF-ON state is also delayed, so that the pixel electrodes connected to the TFTs 22 being in such HALF-ON state shows a moderate potential variation. More specifically, as seen in FIG. 4, with regards to the display that is provided with the erasing circuit 6, the potential variation in the pixel electrode 21 is represented by a curve Vx, whereas with regards to the display that is not provided with the erasing circuit 6, the potential variation in the pixel electrode 21 is represented by a curve Vx' indicated by a broken line. Further, in the case of the display that is not provided with the erasing circuit 6, the potential variation in the common electrode 25 is represented by a curve Vu'. Thus, in case of the display that is not provided with the erasing circuit 6, the instant when the potential difference between the common electrode 25 and each pixel electrode 21 becomes zero is delayed by T2 in comparison with the display that is provided with the erasing circuit 6, so that the erasing time te with respect to the display that is not provided with the erasing circuit 6 is te=t1+T2, which is specifically equal to about 4 to 5 seconds. As a result, it is recognized that the erasing time te could be shortened by about 3 seconds by providing the erasing circuit 6.

Further, in this embodiment, the erasing circuit 6 detects three potentials Vs, Vg and Vo generated by the potential generating circuit 5 and operates on the basis of the detected potentials. Accordingly, there is no need to provide a expensive voltage detector IC for specifically driving the erasing circuit 6, which may be resulted in a reduction of the cost.

Furthermore, in this embodiment, the erasing circuit 6 operates only by three potentials Vs, Vg and Vo. That is to say, the erasing circuit 6 operates without depending on such signal as the horizontal synchronization signal. Accordingly, the erasing circuit 6 can be designed without considering such signal characteristic.

It should be particularly noted that the one end of the charge flowing portion 67 is grounded in this embodiment but the one end of the charge flowing portion 67 may be nongrounded.

Besides, in this embodiment, in order to shift the TFT 22 to a HALF-ON state in a short time, the switching element 62 is connected to the supplying line L3 such that the electric charge accumulated in the gate bus 23 could flow into the charge flowing portion 67 through the supplying line L3 and the switching element 62. In accordance with this structure, the potential of the gate electrode 22*a* of the TFT 22 could become zero in a short time and the TFT 22 could accordingly become in a HALF-ON state in a short time. However, as long as the switching element 62 is connected to any path that electrically connects between the potential generating circuit 5 and the pixel electrode 21, it may be possible to shift the TFT 22 to a HALF-ON state in a short time even if the switching element 62 is connected to any other portion than the supplying line L3.

Furthermore, although the erasing circuit 6 is constituted by two switching elements 61 and 62 and three resistors Ra, Rb and Rc, any other configuration may be allowable.

Figure 5:
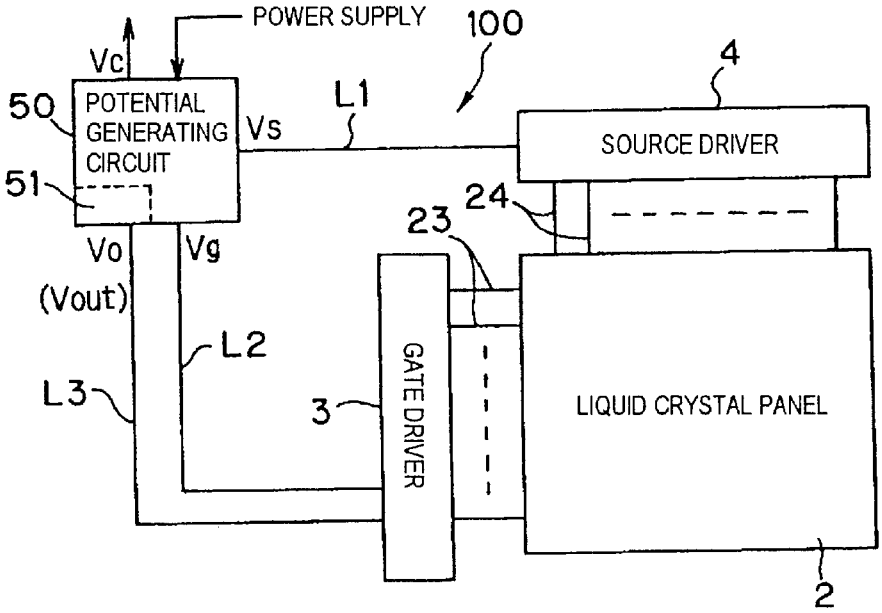
FIG. 5 is a schematic diagram illustrating an exemplary TFT liquid crystal display as a second embodiment of the liquid crystal display device in accordance with the invention.

FIG. 5 is a schematic diagram illustrating an display as a second embodiment of the liquid crystal display device in accordance with the invention. In describing the display 100 in FIG. 5, same reference numerals are used in FIG. 5 for the same components as for the display 1 in FIG. 1, and only the difference from the display 1 in FIG. 1 will be explained in the following.

The difference between the display 100 shown in FIG. 5 and the display 1 shown in FIG. 1 is only that the display 100 shown in FIG. 5 does not comprise the erasing circuit 6 but instead comprises a potential generating circuit 50, the structure of which is different from that of the potential generating circuit 5 shown in FIG. 1.

Figure 6:
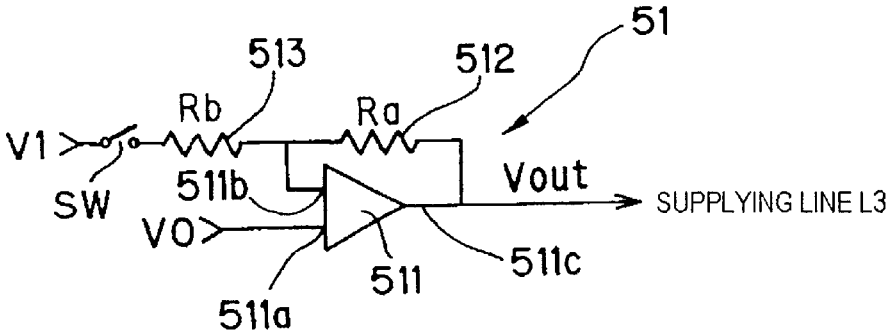
FIG. 6 is a schematic diagram illustrating the potential generating portion 51.

This potential generating circuit 50 comprises a potential generating portion 51 for erasing afterimage on the panel 2. The potential generating portion 51 will be explained below. FIG. 6 shows the potential generating portion 51 in detail. The potential generating portion 51 is provided with a differential amplifier 511. An input terminal 511*a* of the differential amplifier 511 receives the potential Vo generated by the potential generating circuit 50 while another input terminal 511*b* is connected to an output terminal 511*c* of this differential amplifier 511 via a resistor 512. Additionally, the input terminal 511*b* is connected to a switching element SW via a resistor 513. The switching element SW is opened when the DC power is supplied to the potential generating circuit 50 while it is closed when the supply of DC power for the potential generating circuit 50 is stopped. The output terminal 511*c* of the differential amplifier 511 is additionally connected to the supplying line L3 (see FIG. 5).

The following will explain the operation of the display 100 with reference to FIG. 5 and FIG. 6 as well as FIG. 2 when needed.

When the power supply in the main body of the display 100 is turned on, the DC power is supplied to the potential generating circuit 50 so as to generate not only the potentials Vs, Vg, Vo and Vc but also a potential V1 (see FIG. 6). The potentials Vs, Vg, Vc and V1 are positive ones but the potential Vo is a negative one. The potentials Vs, Vg and Vc are supplied to the source bus 4, the gate bus 3 and the common electrode respectively, and the potential Vo is supplied to the input terminal 511*a* of the differential amplifier 511 (see FIG. 6). Besides, although the potential V1 is intended to supply to the differential amplifier 511 via the switching element SW and the resistor 513, the potential V1 cannot be supplied to the differential amplifier 511 while the DC power is being supplied to the potential generating circuit 50 because the switching element SW is kept open in this state where the DC power is being supplied to the potential generating circuit 50. Therefore, only the potential Vo is supplied to the differential amplifier 511 while the DC power is being supplied to the potential generating circuit 50. Accordingly, the output potential Vout becomes Vout=Vo, and eventually Vo will be supplied to the supplying line L3. Thus, the potentials Vg and Vo are resultantly supplied to the gate driver 3 via the supplying lines L2 and L3, so that the images could be consecutively displayed on the liquid crystal panel 2 in the same way as for the display 1 shown in FIG. 1.

Secondly, the operation of the display 100 when the power in the main body of the display 100 is turned off will be explained.

When the power supply in the main body of the display 100 is turned off, the image signal supplied to the source driver 4 is turned off and the supply of the DC power for the potential generating circuit 50 is stopped, so that the circuit 50 stops generating the potentials Vs, Vg, Vo, Vc and V1. It should be noted that the each potential Vs, Vg, Vo, Vc and V1 still does not reach zero immediately after the supply of the DC power for the potential generating circuit 50 is stopped. Accordingly, the potential Vg (>0) is supplied to one gate bus 23 just before the potential generating circuit 50 stops generating the potentials, and that said one gate bus 23 still has a potential larger than zero immediately after the potential generating circuit 50 stops generating the potential. Therefore, the TFT 22 (see FIG. 2) that is connected to said one gate bus 23 still remains in the ON state. Then, a signal indicating that the image signal is OFF, via the source bus 24, will be written to the pixel electrode 21 which is connected to the TFT 22 being in such ON state, so that the potential of this pixel electrode 21 may instantaneously become zero.

Additionally, the switching element SW shown in FIG. 6 is closed in the case that the supply of DC power for the potential generating circuit 50 is stopped. The output potential Vout just after the switching element SW has been closed can be represented by the following equation (7):

$$Vout=(Vo-V1)\times Ra/Rb+Vo \quad (7)$$

where Ra represents a resistance value of the resistor 512, and Rb represents a resistance value of the resistor 513. In this case, the values for Ra and Rb are adjusted such that Vout becomes Vout=0V just after the switching element SW has been closed. Accordingly, although the potential Vo (<0) is supplied to 799 gate bus 23 just before the potential generating circuit 50 stops generating the potentials, a zero potential can be written instantaneously to the 799 gate buses 23 via the supplying line L3 just after the potential generating circuit 50 has stopped generating the potentials. Here consider that the display 100 shown in FIG. 5 does not comprise the potential generating portion 51. In this case, when the power in the main body of the display 100 is turned off, the potential in the 799 gate buses 23 can not reach zero until the electric charge accumulated in the gate buses 23 naturally disappears from the gate buses 23. In contrast, as with the display 100 shown in FIG. 5, in the case of providing the potential generation portion 51 that supplies the potential Vout=0V to the supplying line 3 immediately after the supply of the DC power for the potential generating circuit 50 has been stopped, the potential of the gate buses 23 could be set to zero instantaneously without awaiting the natural disappearing of the charge being accumulated in the gate buses 23 from the gate buses 23.

Besides, the potential of the source electrode 22*b* of this TFT 22 becomes zero because the image signal has been turned off, so that the potential difference between the gate electrode 22*a* and the source electrode 22*b* of each TFTs 22 connected to the 799 gate buses 23 could become zero. In the case that the potential difference between the gate electrode 22*a* and the source electrode 22*b* of each TFTs 22 is zero, the each TFTs 22 shifts to the HALF-ON state, so that, the electric charge accumulated in the pixel electrode 21 could be quickly removed from the pixel electrode 21 through the TFT 22 being in the HALF-ON state. As a result, the potential of this pixel electrode 21 reaches zero. In this way, the potentials of all pixel electrodes 21 of the liquid crystal panel 2 could be changed to zero quickly. Immediately after the potentials of all pixel electrodes 21 of the liquid crystal panel 2 have reached zero, the potential of the common electrode 25 can reach zero as well. Accordingly, the potential difference between the common electrode 25 and each pixel electrode 21 becomes zero, so that the image on the liquid crystal panel 2 could be completely erased.

Thus, it is possible to shorten the erasing time even if the TFT 21 is forced to a HALF-ON state by means of the potential generating portion 51.

In the case of the display 100 shown in FIG. 5, the potential generating portion 51 generating the potential for erasing the afterimage detects two potentials Vo and V1 generated by the potential generating circuit 50 and operates on the basis of the detected potentials. Accordingly, there is no need to provide a expensive voltage detector IC for specifically driving the erasing circuit 6, which may be resulted in a reduction of the cost.

Besides, in the case of the display 100 shown in FIG. 5, the potential generating portion 51 operates only by three potentials Vs, Vg and Vo. That is to say, the potential generating portion 51 operates without depending on such signal as the horizontal synchronization signal. Accordingly, the potential generating portion 6 can be designed without considering such signal characteristic.

Furthermore, in the case of the display 100 shown in FIG. 5, in order to shorten the erasing time, the TFT 21 is set to a HALF-ON state by using the way that the differential amplifier 511 outputs Vout=0V when the supply of the DC power for the potential generating circuit 50 is stopped. However, Vout may be larger than zero. If Vout is larger than zero, the TFT 21 is set to a full ON state rather than a HALF-ON state and the signals indicating that the image signal is OFF can be written to the pixel electrodes, so that the erasing time could be shortened.

In this display shown in FIG. 5, the potential generating portion 51 is a part of the potential generating circuit 50. However, the potential generating portion 51 may be separated from the potential generating circuit 50.

In each of the aforementioned first and second embodiments of the liquid crystal display device in accordance with the invention, the supply and the supply stop of the DC power for the potential generating circuits 5 and 50 are performed when the power supply in the main body of the display 1 and display 100 is turned on or off. However, if the display 1 and the display 100 are used as a display for a personal computer for example, the supply and the supply stop of the DC power for the potential generating circuits 5 and 50 may be performed when the main body of the personal computer rather than the display 1 or 100 is turned on or off. Thus, the invention is not intended to limit the method for the supply and the supply stop of the DC power for the potential generating circuits 5 and 50.

Furthermore, the liquid crystal display device in accordance with the invention may be applied to any other electronic device than the personal computer.

As aforementioned, in accordance with the liquid crystal display device in accordance with the invention, it is possible to shorten the erasing time less expensively without detecting such signal as horizontal synchronization signal.

What is claimed is:

1. A liquid crystal display device comprising:

a first electrode and a second electrode for applying a voltage to a liquid crystal layer;

a first bus and a second bus that are electrically connected to said first electrode via first switching means;

potential generation means for generating a first potential that is supplied toward said first switching means via a path containing said first bus;

a charge flowing portion into which electric charges existing in said path, said first electrode or said potential generation means may flow; and a second switching means for switching a state of the flow of electric charges into said charge flowing portion to either a first state in which said electric charges flow into said charge flowing portion or a second state in which said electric charges do not flow into said charge flowing portion so much as in said first state.

2. A liquid crystal display device as claimed in claim 1, characterized in that said charge flowing portion is set to said first state when said second switching means is in an ON state whereas said charge flowing portion is set to said second state when said second switching means is in an OFF state.

3. A liquid crystal display device as claimed in claim 2, characterized in that said liquid crystal display device further comprises control means for controlling said second switching means so that said second switch means is switched to either an ON state or an OFF state.

4. A liquid crystal display device as claimed in claim 3, characterized in that said potential generation means generates a plurality of potentials, and that said control portion detests said plurality of potentials generated by said potential generation means and controls said second switching means so that said second switch means is switched to either an ON state or an OFF state on the basis of said detected potentials.

5. A liquid crystal display device as claimed in claim 4, characterized in that the device further comprises a first driver for transmitting signals to said first bus and a second driver for transmitting signals to said second bus, and that said potential generation means generates a second potential to be supplied toward said first driver and a third potential to be supplied toward said second driver in addition to said first potential, and that said control portion detects said first, second and third potentials and controls said second switching means so that said second switching means is switched to either an ON state or an OFF state on the basis of said detected potentials.

6. A liquid crystal display device as claimed in claim 3, characterized in that said control portion comprises a third switching means for switching an ON state and an OFF state of said second switching means.

7. A liquid crystal display device as claimed in claim 1, characterized in that said first electrode is a pixel electrode and said second electrode is a common electrode.

8. A liquid crystal display device as claimed in claim 1, characterized in that said first bus is a gate bus and said second bus is a source bus.

9. A liquid crystal display device as claimed in claim 5, characterized in that said first driver is a gate driver and said second driver is a source driver.

10. A liquid crystal display device comprising:

a first electrode and a second electrode for applying a voltage to a liquid crystal layer;

a first bus and a second bus which are electrically connected to said first electrode via first switching means; and potential generation means for generating a first potential which is supplied toward said first bus, characterized in that said potential generation means generates a second potential to be supplied toward said first bus when the supply of the power for said potential generation means has been stopped, said second potential being larger than said first potential.

11. A liquid crystal display device as claimed in claim 10, characterized in that said potential generation means comprises a differential amplifier that outputs said second potential.

12. A liquid crystal display device as claimed in claim 10, characterized in that said first electrode is a pixel electrode and said second electrode is a common electrode.

13. A liquid crystal display device as claimed in claim 10, characterized in that said first bus is a gate bus and said second bus is a source bus.

* * * * *